US011504760B2

(12) United States Patent
Champagne

(10) Patent No.: US 11,504,760 B2
(45) Date of Patent: Nov. 22, 2022

(54) DROPPED CEILING HANGER WIRE BENDING DEVICE

(71) Applicant: CITX4 inc., Mascouche (CA)

(72) Inventor: Franky Champagne, Mascouche (CA)

(73) Assignee: GESTION T.F.C. INC., Mascouche (CA)

( * ) Notice: Subject to any disclaimer, the term of this patent is extended or adjusted under 35 U.S.C. 154(b) by 0 days.

(21) Appl. No.: 17/252,224

(22) PCT Filed: Mar. 9, 2020

(86) PCT No.: PCT/CA2020/050314
§ 371 (c)(1),
(2) Date: Dec. 14, 2020

(87) PCT Pub. No.: WO2020/181369
PCT Pub. Date: Sep. 17, 2020

(65) Prior Publication Data

US 2021/0252583 A1 Aug. 19, 2021

(30) Foreign Application Priority Data

Mar. 12, 2019 (GB) ..... 1903398

(51) Int. Cl.
*B21F 1/00* (2006.01)
*E04B 9/18* (2006.01)

(52) U.S. Cl.
CPC ..... *B21F 1/002* (2013.01); *E04B 9/18* (2013.01)

(58) Field of Classification Search
CPC .. B21F 1/00; B21F 1/002; B21F 1/004; B21F 1/008; B21F 33/00; B21F 1/006; B21D 9/085; B21D 7/024; B21D 7/02
USPC ..... 140/117, 233; 254/134.3 pa
See application file for complete search history.

(56) References Cited

U.S. PATENT DOCUMENTS 2,857,792 A * 10/1958 McNish ..... E04B 9/18 72/458
3,030,984 A * 4/1962 Vogt ..... E04F 21/00 140/122
4,091,845 A * 5/1978 Johnson ..... B21F 1/002 140/106
4,304,117 A 12/1981 Rawson
(Continued)

OTHER PUBLICATIONS

International Search Report, 3 pages, dated May 27, 2020.

*Primary Examiner* — Adam J Eiseman
*Assistant Examiner* — Matthew Stephens
(74) *Attorney, Agent, or Firm* — Benoit & Cote Inc.; Mathieu Audet; C. Marc Benoit

(57) ABSTRACT

A wire bending device is adapted for bending hanger wires hanging from a ceiling in preparation of the installation of rails of a suspended ceiling. The bending device comprises a pole having a top extremity, a head module mounted to the pole, and a pair of handles distant from the head module for holding and activating the head module. The head module comprises a casing, a motor enclosed in the casing, a channel housed by the casing for receiving the hanger wire; and a push member driven by the motor travelling between an hanger wire insert position and a wire bend position, wherein the push member is adapted to push against the hanger wire and bend the hanger wire during its travel. Thereby, one may operate the bending device from the ground and bend hanger wires for installation of suspended ceiling rails.

20 Claims, 21 Drawing Sheets

(56) References Cited

U.S. PATENT DOCUMENTS

| | | | | |
|---|---|---|---|---|
| 4,331,183 | A * | 5/1982 | Calhoun | B21F 1/06 140/106 |
| 4,413,660 | A | 11/1983 | Conrad | |
| 4,694,869 | A * | 9/1987 | Wolford | B21F 7/00 140/119 |
| 5,161,404 | A | 11/1992 | Hayes | |
| 6,023,959 | A | 2/2000 | Stratton | |
| 6,729,358 | B1 | 5/2004 | Moffatt | |
| 6,786,116 | B2 * | 9/2004 | Dockery | B25B 13/06 279/46.3 |
| 9,067,257 | B2 | 6/2015 | White | |
| 10,427,208 | B2 | 10/2019 | Perry et al. | |
| 2002/0134454 | A1 | 9/2002 | Lawrence | |
| 2007/0137725 | A1 * | 6/2007 | Conde | B21F 1/002 140/106 |
| 2007/0209732 | A1 | 9/2007 | Conde | |
| 2014/0318324 | A1 | 10/2014 | Buchner et al. | |
| 2018/0071901 | A1 * | 3/2018 | Silha | B25B 21/004 140/106 |

* cited by examiner

90

DROPPED CEILING HANGER WIRE BENDING DEVICE

CROSS-REFERENCE TO RELATED APPLICATION

This application claims priority from UK patent application GB1903398.4 filed Mar. 12, 2019, the specification of which is hereby incorporated herein by reference in its entirety.

BACKGROUND

(a) Field

The present invention relates generally to construction hand tools but more particularly to a tool for bending suspended ceiling support rods/hanger wires.

(b) Related Prior Art

Suspended ceilings are virtually the universal norm when it comes to high rise office building ceilings. It is a very low cost, efficient and easy way of making a ceiling which has the advantage of allowing for quick and easy access to the otherwise hidden hardware components such as electrical wires, plumbing, ventilation pipes and ducts, light fixtures and other things such as wires for telecommunication. There is also a second type of suspended ceiling wherein a stronger type of metal profile is used as framework onto which gypsum sheets are screwed on so as to provide for the look of a finished ceiling for residential use, for example.

Typically, the installation consists in setting up a perimeter support frame which is screwed into the buildings concrete structure. This is set precisely level at a standard office ceiling height. From that height, a series of support rods/hanger wires are affixed to the concrete ceiling structure (or steel trusses) and are hanging, waiting to all be bent at the same distance from the floor (or existing ceiling) in such a way that all other support frames will be level relative to the perimeter support frame. The leveling of those hanger wire bends as well as of the perimeter support is achieved by using a laser leveling device. Once the rods/hanger wires are bent at precisely the same height, it is then easy to hook the other support frames exactly at level. From there, the rest of the installation is fairly simple, by putting interstitial rods to separate and hold individual ceiling tiles, translucent light panels and ventilation grilles.

However simple as that may be, the most difficult step is the accurate location of where the bend has to be along the length of the hanger wire so that the ceiling will be perfectly horizontal without any dips and rises. Currently, the way this is done is by having an installer climbing on a movable scaffold or even simply a stepladder positioned under a hanger wire and holding an object, such as a measuring tape, for example, which is set at a chosen length so that a laser beam hits a pre-selected spot on the object wherein a top end of the object (the end of the tape for example) indicates where to make the bend using pliers or a small bending tool. The installer then climbs down the ladder or scaffold, moves it under the next hanger wire and repeats the process. The climbing onto, stepping off from and moving scaffolders or stepladder is tedious and time consuming. There has to be a better, more efficient way of performing this task.

SUMMARY

It is a main object of the present disclosure to provide a tool for bending suspended ceiling support rods/hanger wires.

In order to do so, according to an embodiment there is provided a tool comprised of a long pole wherein a bottom portion has a rotatable handgrip and a fixed handgrip above it. A distal end of the pole has a head module. The head module has a channel configured for receiving a hanger wire therein. A lever member is rotated by the action of the rotatable pole so as to apply pressure on the hanger wire in order to give it a bend. Between the handgrips and the head module can be optionally located. A laser light reflecting plate may be used to guide the installer in moving the pole up or down so that the bend is made at the correct location. The laser light reflecting plate can be moved up or down along the pole so as to calibrate it according to be relative position of the laser emitter and the desired suspended ceiling height.

An advantage of the tool is that the installer does not have to move up and down and move a scaffold or stepladder. Also, there is no need to use some awkward device along with a pair of pliers to do the work. Everything is comprised in this single tool.

According to another embodiment, there is provided a bending device for bending a hanger wire hanging vertically from a ceiling, the bending device comprising: a pole having a top extremity; and a head module mounted to the top extremity of the pole, comprising: a channel extending vertically for receiving the hanger wire horizontally; and a push member travelling between an insert position, wherein the channel is free to receive the hanger wire, and a bend position, wherein the push member is adapted to push against the hanger wire and bend the hanger wire while travelling from the insert position to the bend position.

According to an aspect, the head module comprises a sheave housed in the channel below the push member, and wherein the hanger wire abuts against the sheave and the sheave forces the hanger wire in a direction which is opposite a direction in which the push member travels to bend the hanger wire.

According to an aspect, the head module comprises a first wall and a second wall delimiting the channel having an open top, wherein the first wall and the second wall extend in respective vertical planes which are parallel to each other.

According to an aspect, the first wall and second wall define a funnel shape along a horizontal plane.

According to an aspect, the first wall and the second wall define a conduit providing passage to the push member while moving from the insert position to the bend position.

According to an aspect, the push member comprises a tooth crossing the channel to contact the hanger wire.

According to an aspect, the head module comprises a magnet mounted in the channel for holding the hanger wire in place horizontally.

According to an aspect, the bending device further comprises a motor and wherein the motor drives the push member.

According to an aspect, the bending device further comprises a main handle mounted on the pole distant from the head module, the main handle comprises a trigger for activating the motor and thereby driving the push member.

According to an aspect, the main handle comprises a battery-receiving interface.

According to an aspect, the bending device further comprises a secondary handle distant from the head module.

According to an aspect, the pole further comprises a rotatable handgrip and a fixed handgrip both distant from the top extremity, wherein the rotatable handgrip is mechanically connected to the push member and the rotation of the rotatable handgrip relative to the fixed handgrip drives the push member.

According to an aspect, the bending device further comprises a level to measure a verticality of the pole with respect to a horizontal plane.

According to an aspect, the bending device further comprises a light reflector to reflect light from a laser leveling device.

According to an embodiment, there is provided a bending device for bending a hanger wire hanging vertically from a ceiling, the bending device comprising: a motor; a channel extending vertically for receiving the hanger wire horizontally; a push member driven by the motor travelling between an insert position, wherein the channel is free to receive the hanger wire, and a bend position, wherein the push member is adapted to push against the hanger wire and bend the hanger wire while travelling from the insert position to the bend position; and a means for activating the motor and thereby driving the push member.

According to an aspect, the bending device further comprises a sheave housed in the channel below the push member, and wherein the hanger wire abuts against the sheave and the sheave forces the hanger wire in a direction which is opposite a direction in which the push member travels to bend the hanger wire.

According to an aspect, the bending device further comprises a first wall and a second wall delimiting the channel having an open top, wherein the first wall and the second wall extend in respective vertical planes which are parallel to each other.

According to an aspect, the first wall and second wall define a funnel shape along a horizontal plane.

According to an aspect, the first wall and the second wall define a conduit providing passage to the push member while moving from the insert position to the bend position.

According to an aspect, the push member comprises a tooth crossing the channel to contact the hanger wire.

According to an aspect, the bending device further comprises a magnet mounted about the channel for holding the hanger wire in place horizontally.

According to an embodiment, there is provided a bending device for bending a hanger wire suspended from a ceiling, comprising: a pole comprising a top extremity; a head module mounted to the top extremity, comprising: a channel configured for receiving a hanger wire therein; and a push member configured to bend the hanger wire; and a light reflector installed along the pole to reflect light from a laser leveling device and thereby providing an indication to maintain the bending at a desired height.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
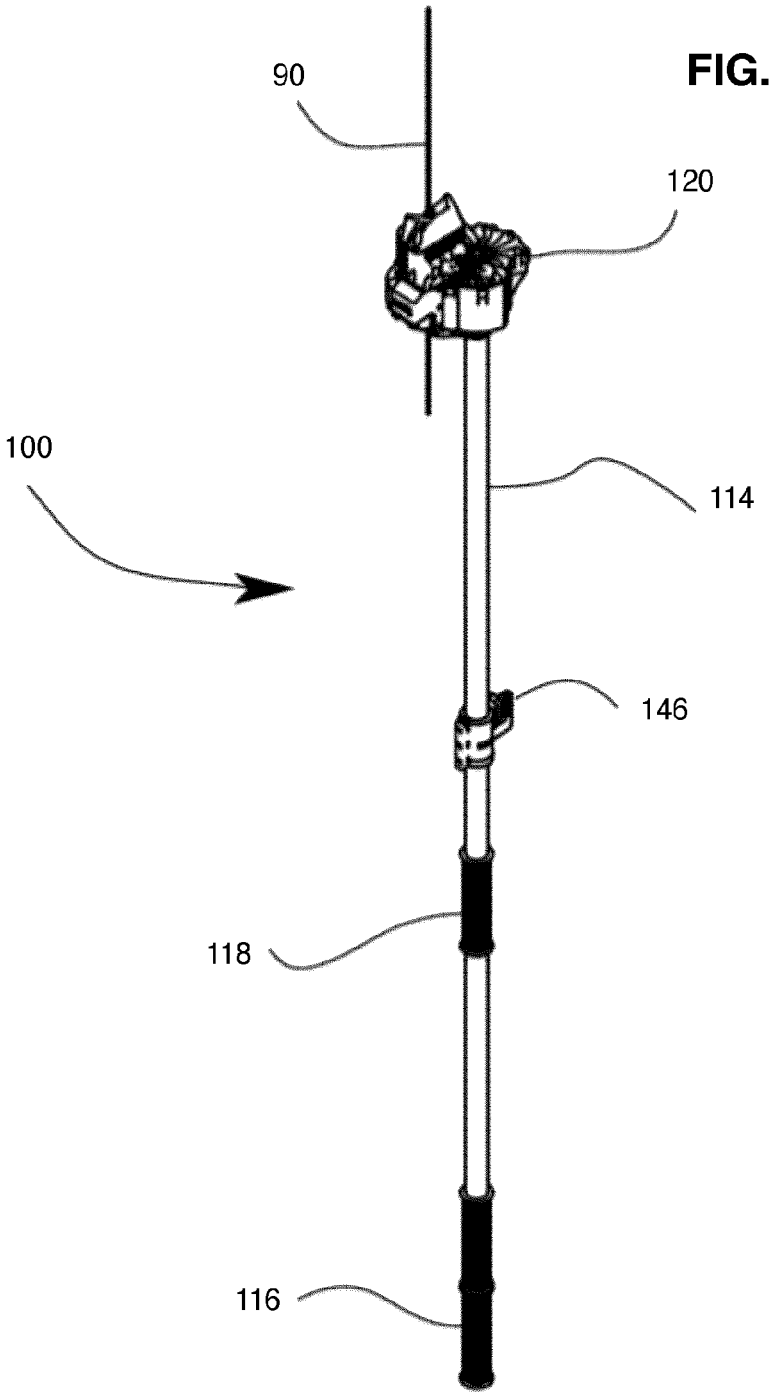
FIG. 1 is a perspective view of a bending device in accordance with an embodiment.
Figure 2:
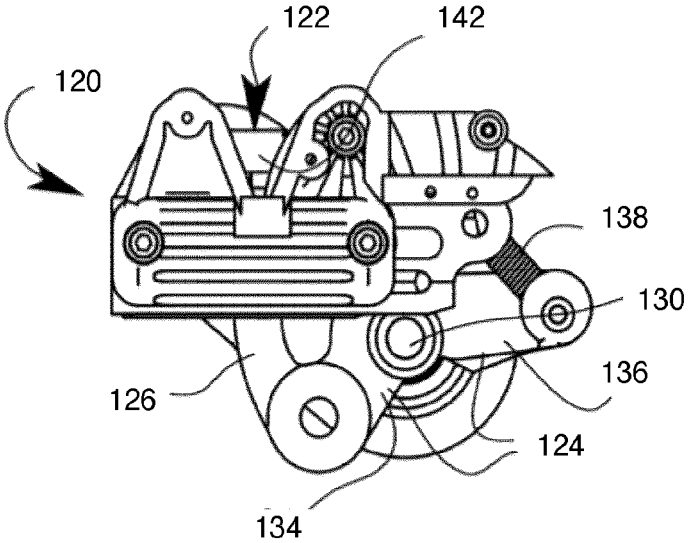
FIG. 2 is a top view of the head module of the bending device of FIG. 1 showing the level and push member.
Figure 3:
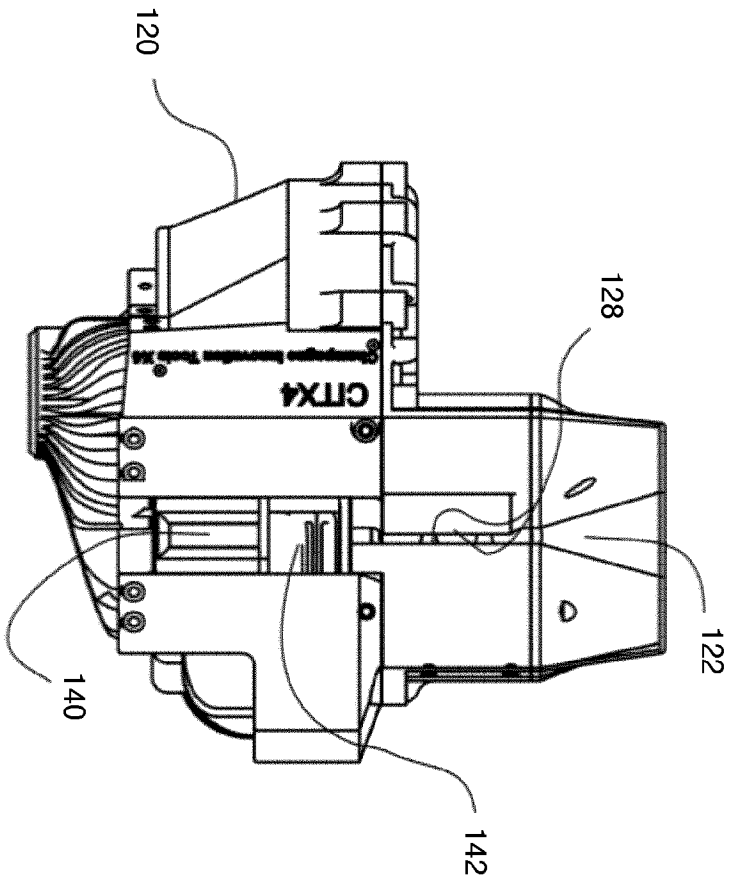
FIG. 3 is a front view of the head module the bending device of FIG. 1 showing the channel and ball bearings.
Figure 4A:
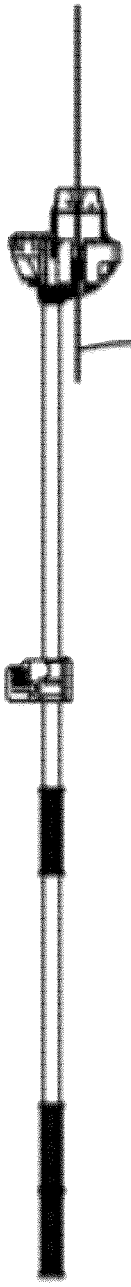
FIGS. 4A-4B are side views of the head module of the bending device of FIG. 1 with a hanger wire inserted while straight and once bent.
Figure 4B:
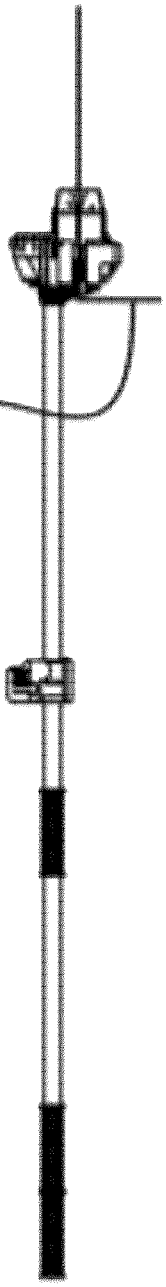

The realizations will now be described more fully hereinafter with reference to the accompanying figures, in which realizations are illustrated. The foregoing may, however, be embodied in many different forms and should not be construed as limited to the illustrated realizations set forth herein.

With respect to the present description, references to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values and of values herein or on the drawings are not intended to be limiting, referring instead individually to any and all values falling within the range, unless otherwise indicated herein, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described realizations. The use of any and all examples, or exemplary language ("e.g.," "such as," or the like) provided herein, is intended merely to better illuminate the exemplary realizations and does not pose a limitation on the scope of the realizations. No language in the specification should be construed as indicating any unclaimed element as essential to the practice of the realizations.

In the following description, it is understood that terms such as "first", "second", "top", "bottom", "above", "below", and the like, are words of convenience and are not to be construed as limiting terms.

The terms "top", "up", "upper", "bottom", "lower", "down", "vertical", "horizontal", "interior" and "exterior" and the like are intended to be construed in their normal meaning in relation with normal use of the product, therefore with up pointing to the ceiling and down to the ground.

In realizations, there are disclosed embodiments of a bending device 100, aka tool for bending suspended ceiling support rods/hanger wires.

It will be noted that throughout the appended drawings, like features are identified by like reference numerals.

Referring now to the drawings, and particularly to FIGS. 1 to 4A-4B, according to an embodiment, there is provided a bending device 100 for bending suspended ceiling hanger wires 90. The bending device 100 comprises a long pole 114 wherein a proximal end has a rotatable handgrip 116 and a fixed hand grip 118 located above it. A distal end of the pole 114 has a head module 120. The head module 120 has a channel 122 configured for receiving one hanger wire 90 therein. A lever member 124 located proximal the channel 122 is pivoted so as to push on a push member 126 which creates a bend on the hanger wire 90 by applying pressure thereto. The lever member 124 is pivoted by the rotating action of an inner rod (not shown) which is located within hollow pole 114. The lever member 124 has a short section 134 and a long section 136 located, each located on opposite sides of a pivot point 130. The long section 136 is attached to a spring 138 and the short section 134 pushes against the push member 126. The push member 126 has a proximal end making contact with the long section 136 and a distal end made of a sheave 140 wherein the hanger wire 90 sits into a groove (not identified) in the sheave 140. The channel 122 has a blocker 142 which holds the hanger wire 90 inside when the push member pushes the hanger wire 90 so as to create the bend. Typically, the bend should be at about a perpendicular angle/right angle.

Between the hand grips 116, 118 and the head module 120 is a laser light reflecting plate 146 which guides the installer in moving the pole 114 up or down so that the bend is made at the correct location on the hanger wire 90. The laser light reflecting plate 146 can be moved up or down along the pole 114 so as to calibrate it according to the relative position of a laser light emitter (not shown) and the desired suspended ceiling height.

The channel 122 is further comprised of a pair of ball bearing tracks 128 located on its sides so as to reduce friction and thus facilitate the up and down motion of the pole 114 as well as reducing wear in the channel 122.

Figure 5:
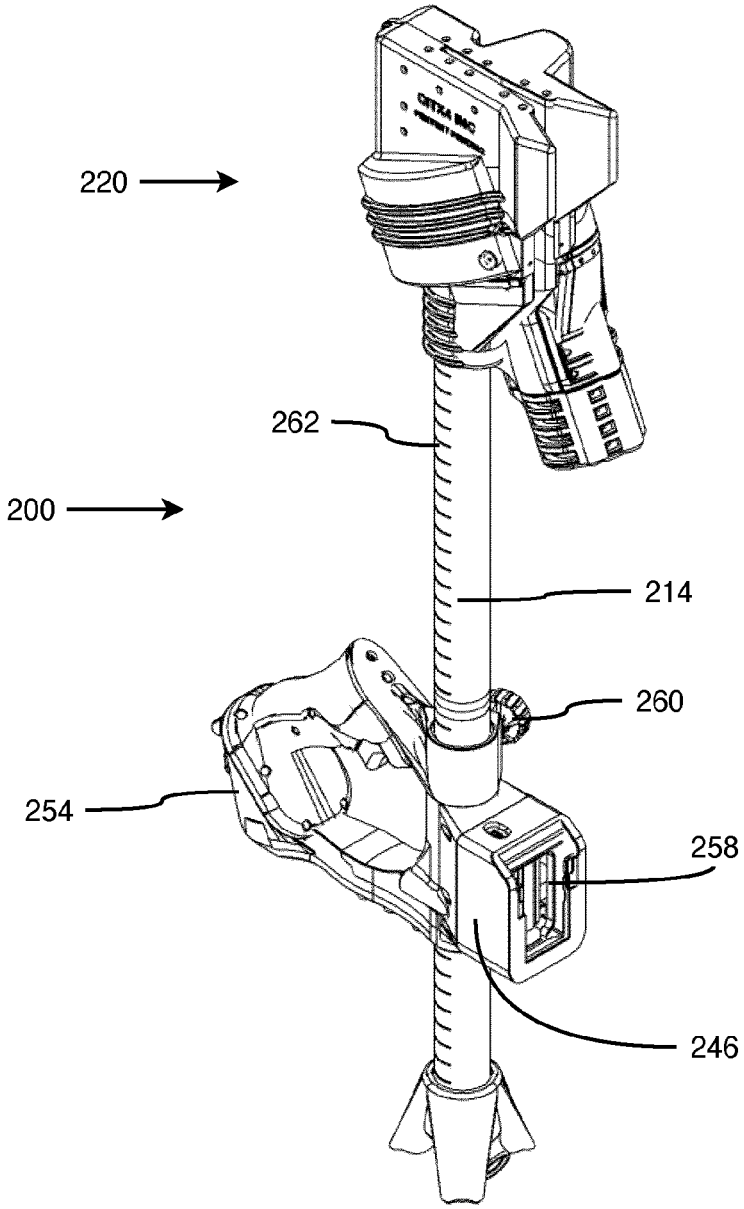
FIG. 5 is a perspective view of a bending device in accordance with another embodiment.
Figure 6:
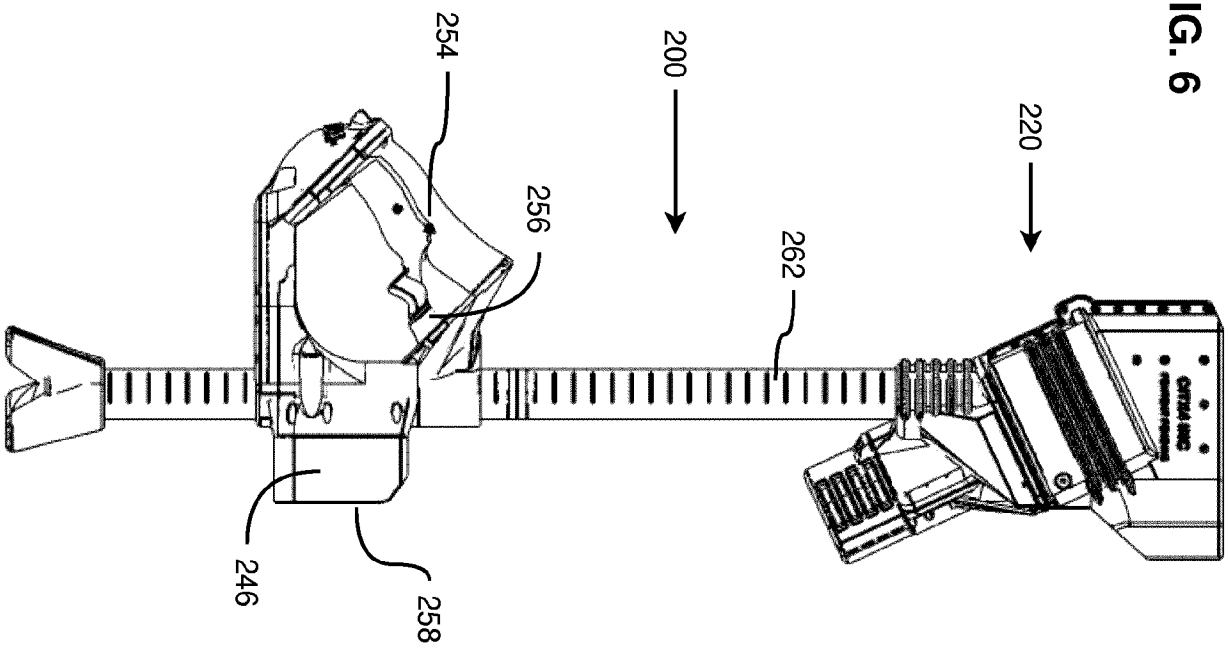
FIG. 6 is a side view of the bending device of FIG. 5.
Figure 7:
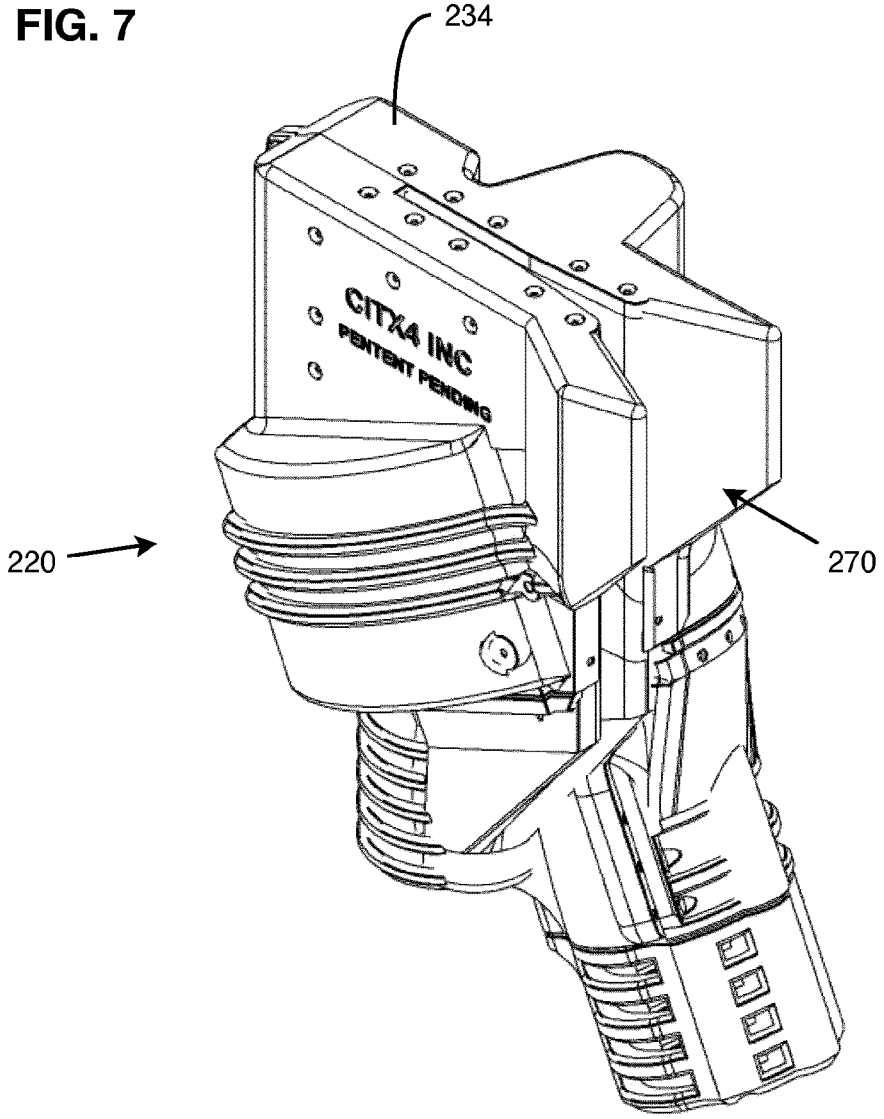
FIG. 7 is a perspective view of a head module of the bending device of FIGS. 5 and 6.
Figure 8:
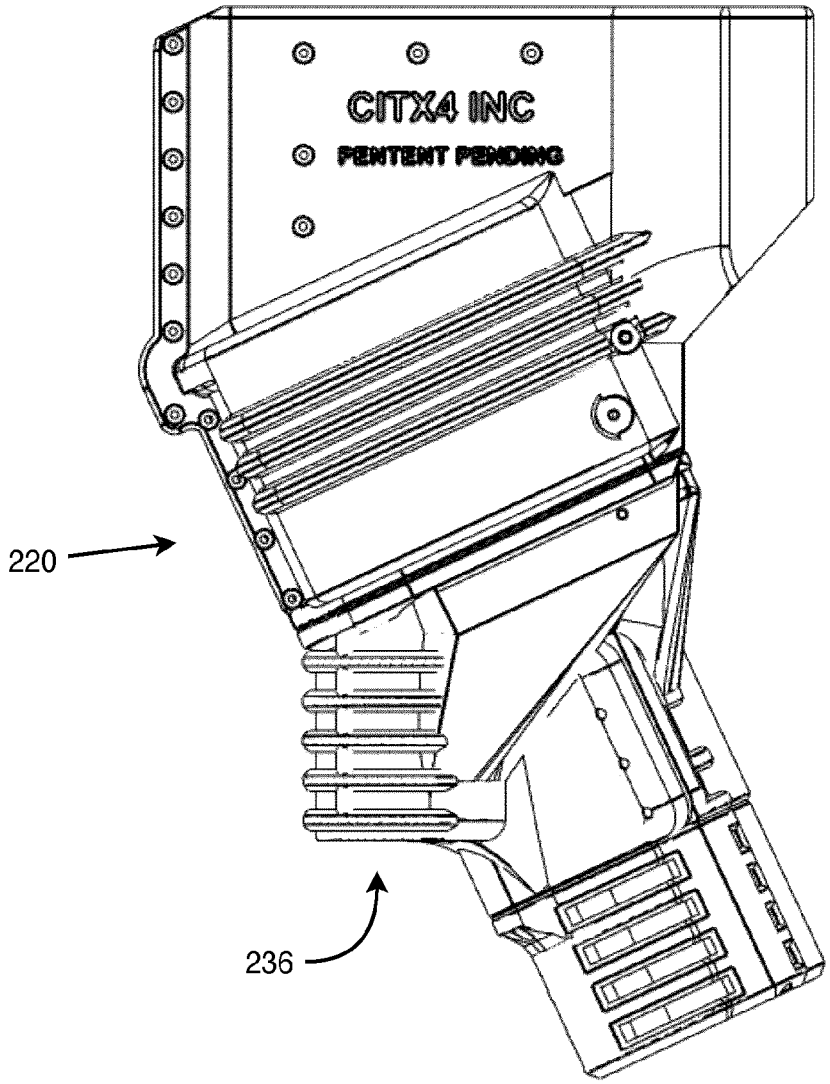
FIGS. 8 to 10 are respectively a side view, a front view and a top view of the bending device of FIGS. 5 and 6.
Figure 9:
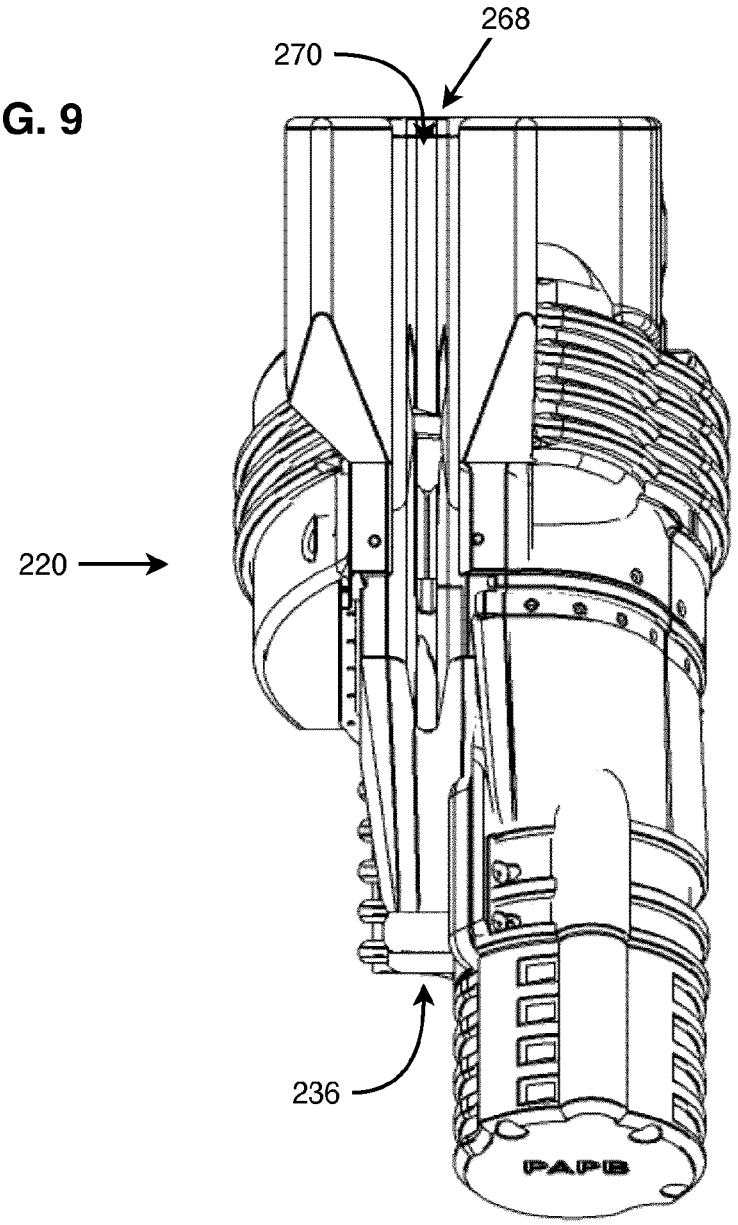
Figure 10:
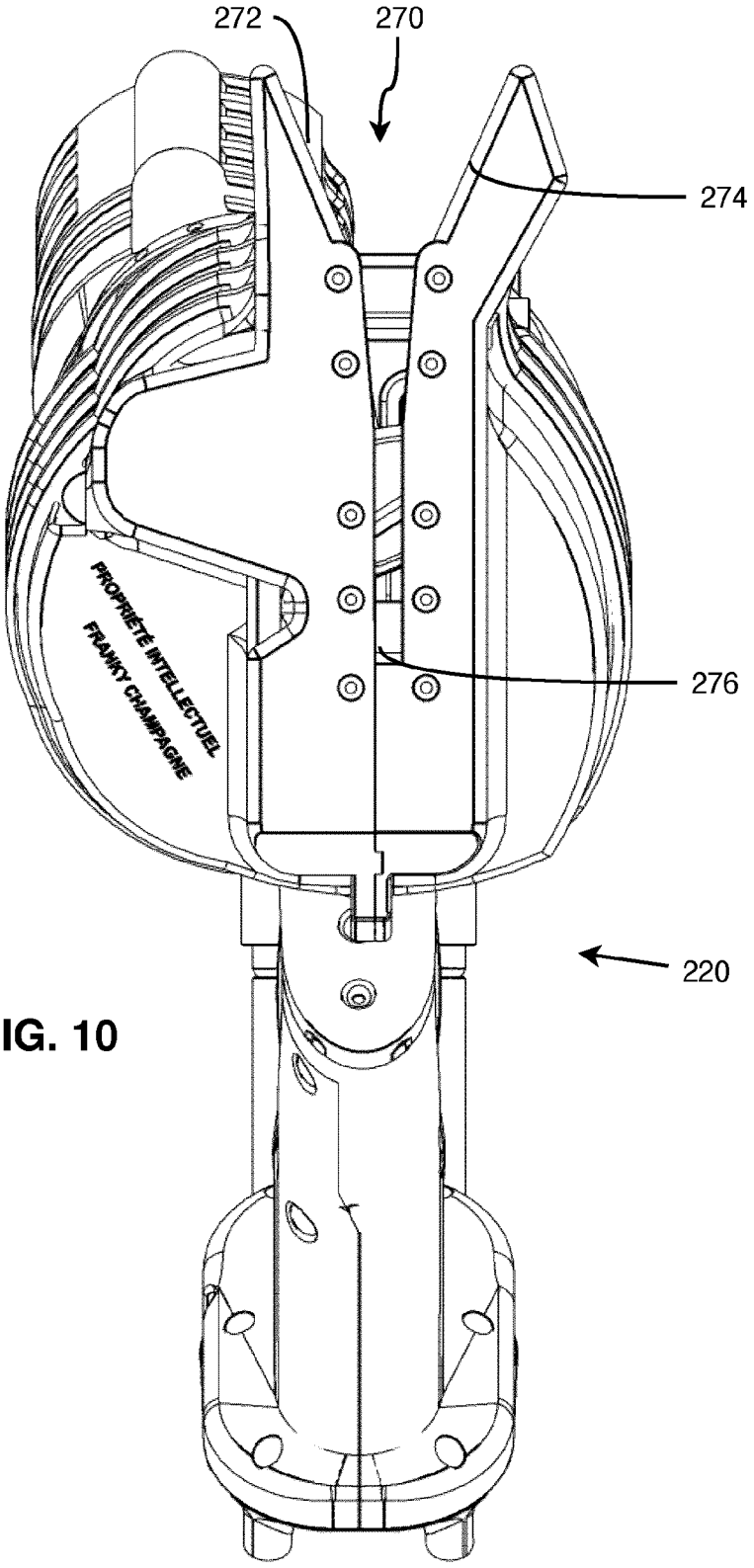
Figure 11:
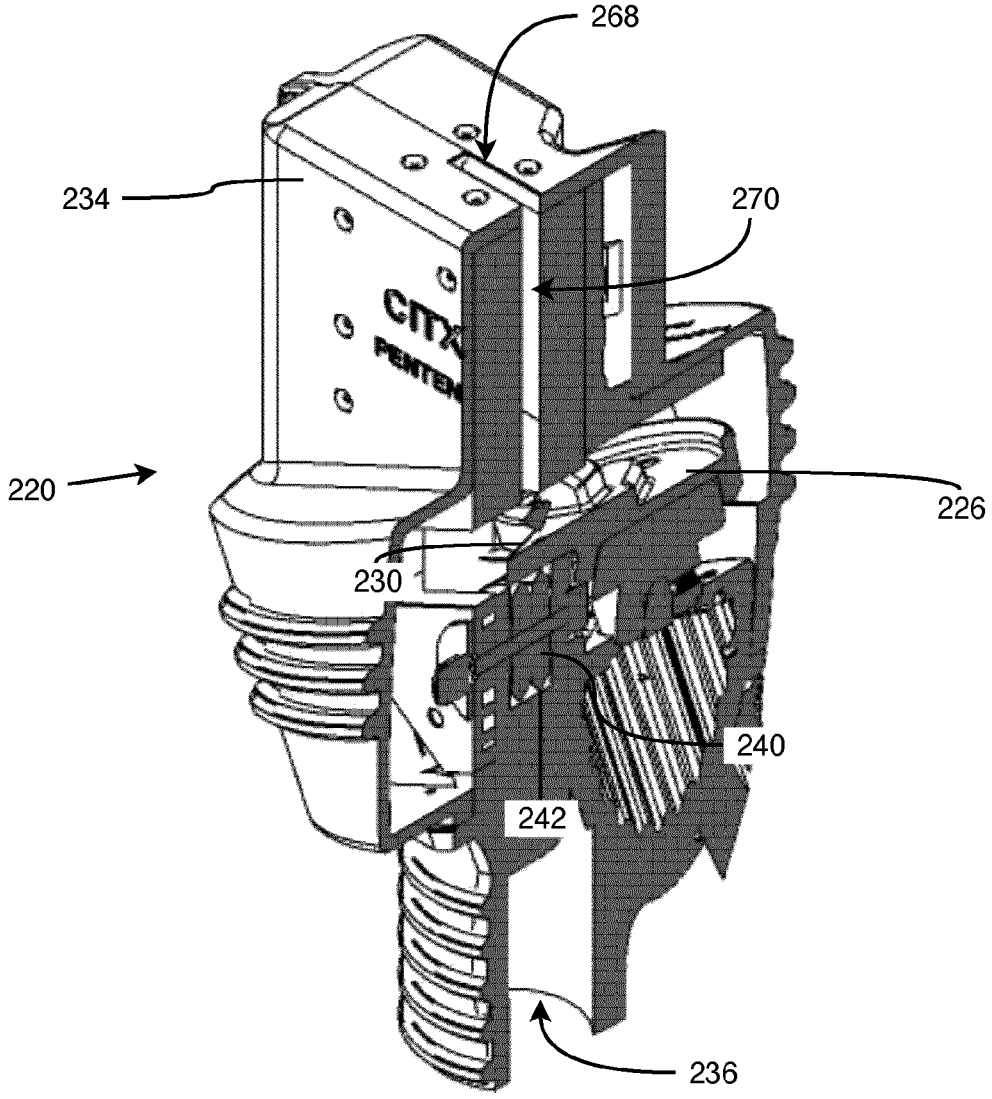
FIG. 11 is a cross section perspective view of the head module along a vertical plane perpendicular to the orientation of the channel.
Figure 12:
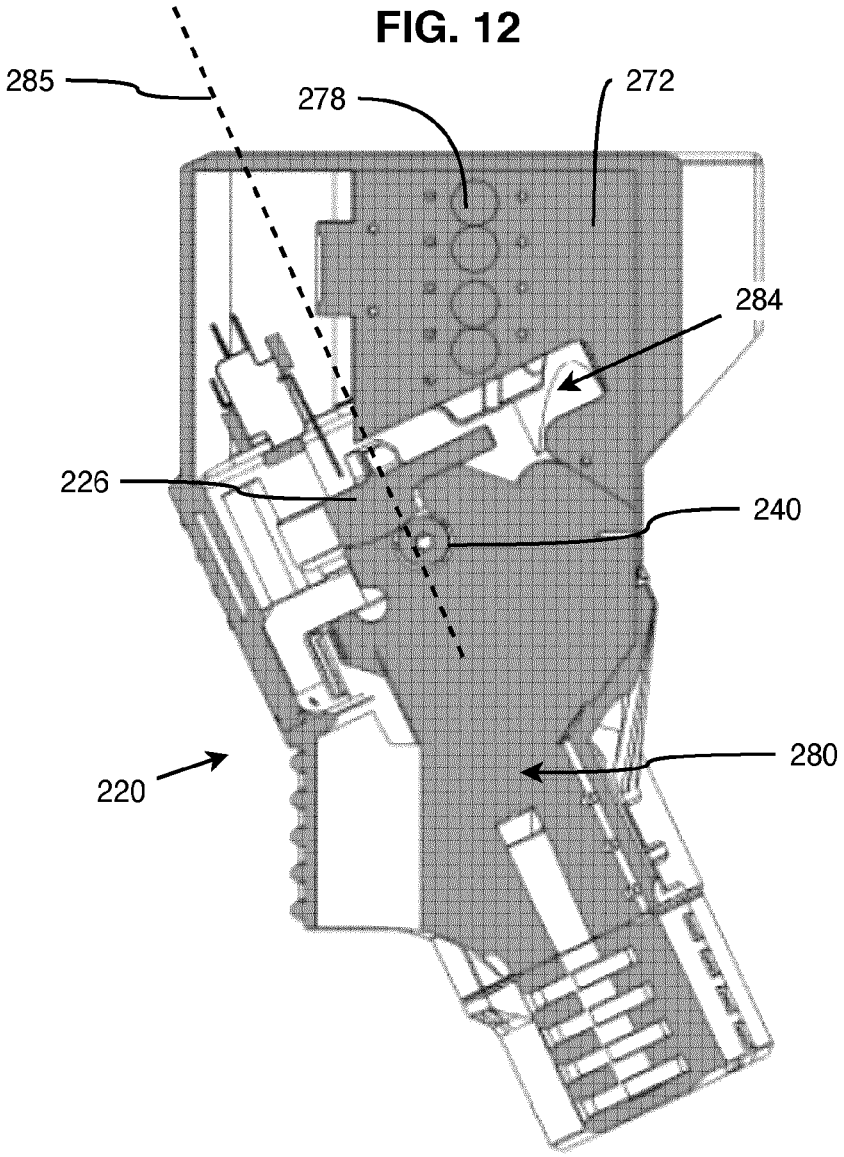
FIG. 12 is cross section side view of the head module of FIGS. 7 to 11 according to a cross section plan perpendicular to the front view.
Figure 13:
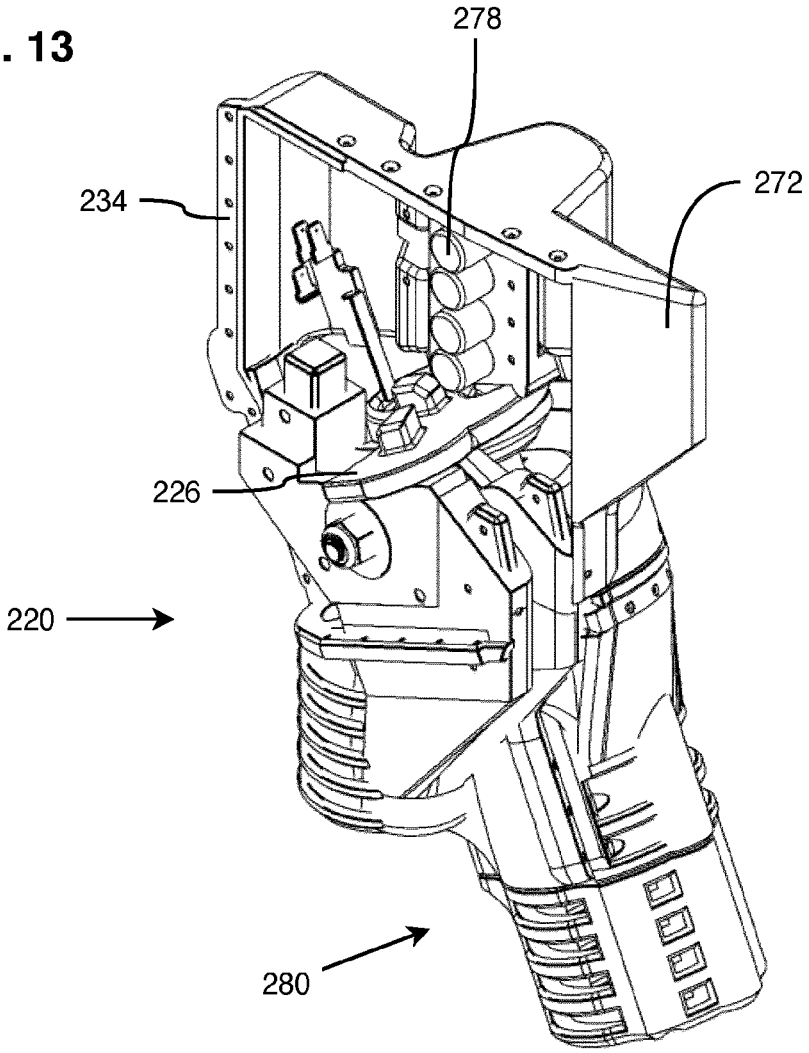
FIG. 13 is perspective view of the head module of FIGS. 7 to 11 with a portion of the casing and a side wall on one side removed.
Figure 14:
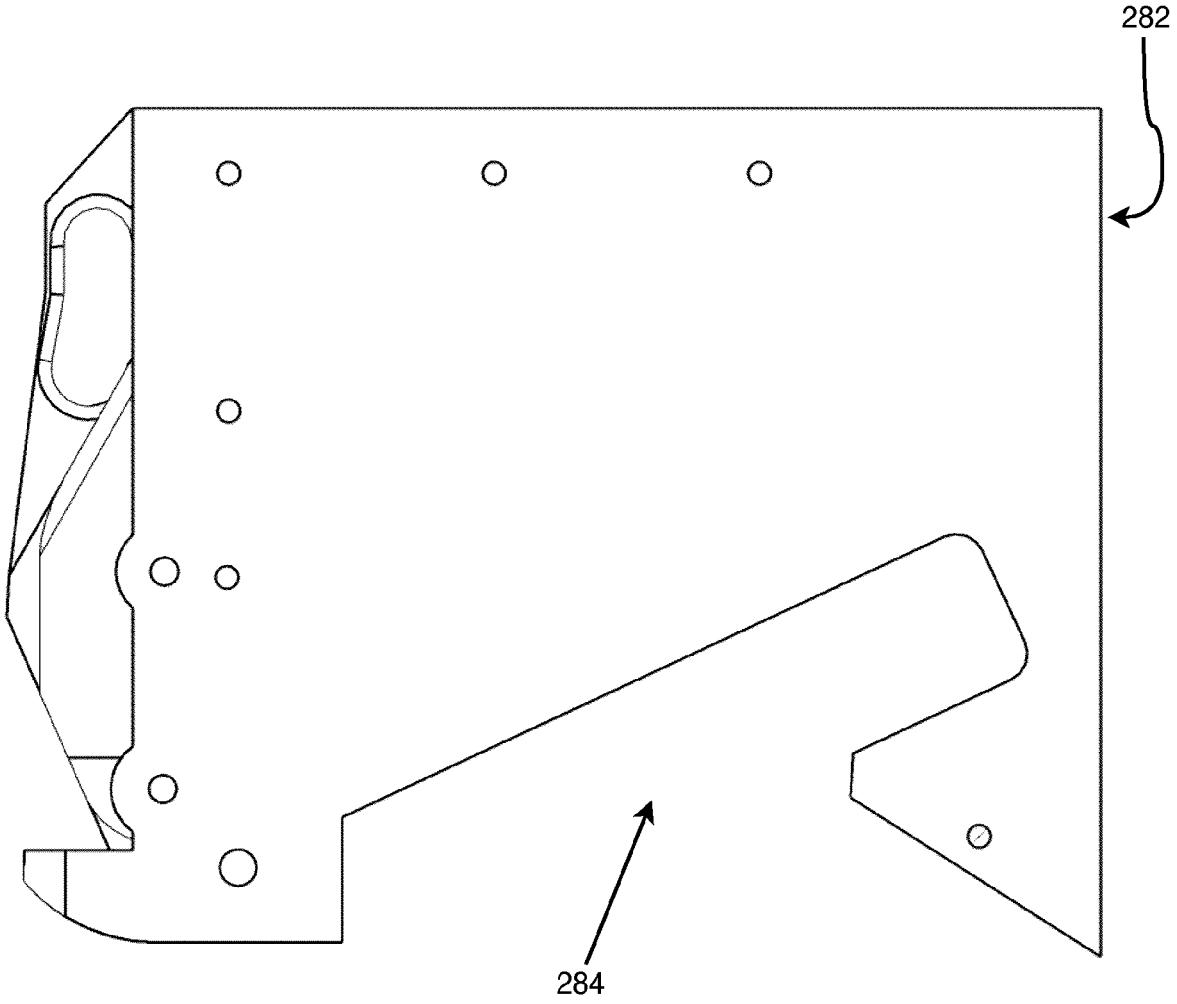
FIGS. 14 to 16 are respectively a side view, a front view and a top view of the channel adapted to receive hanger wires.
Figure 15:
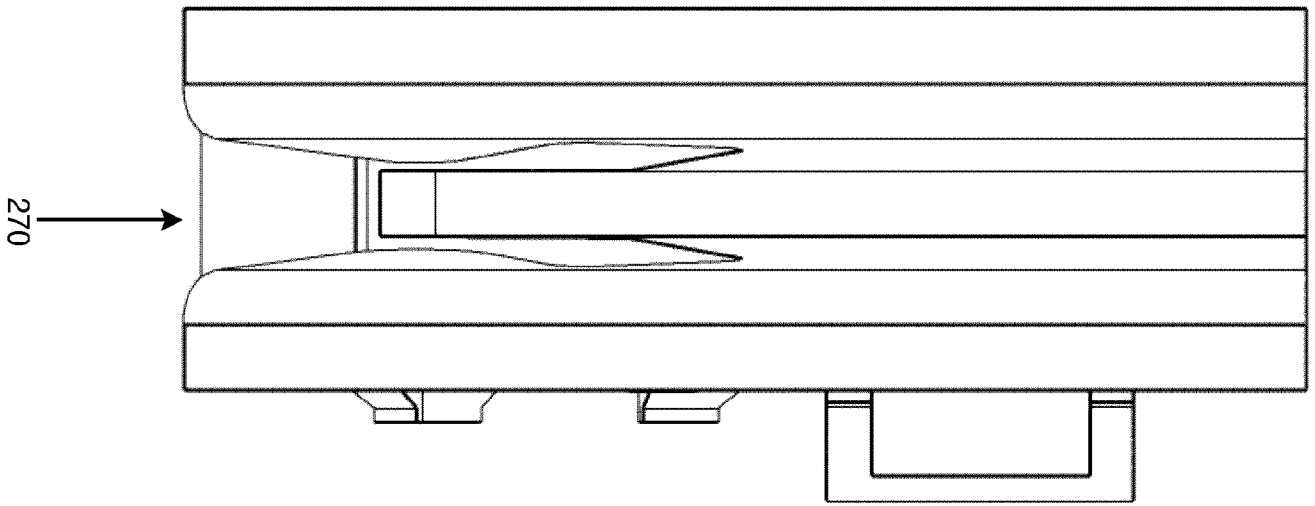
Figure 16:
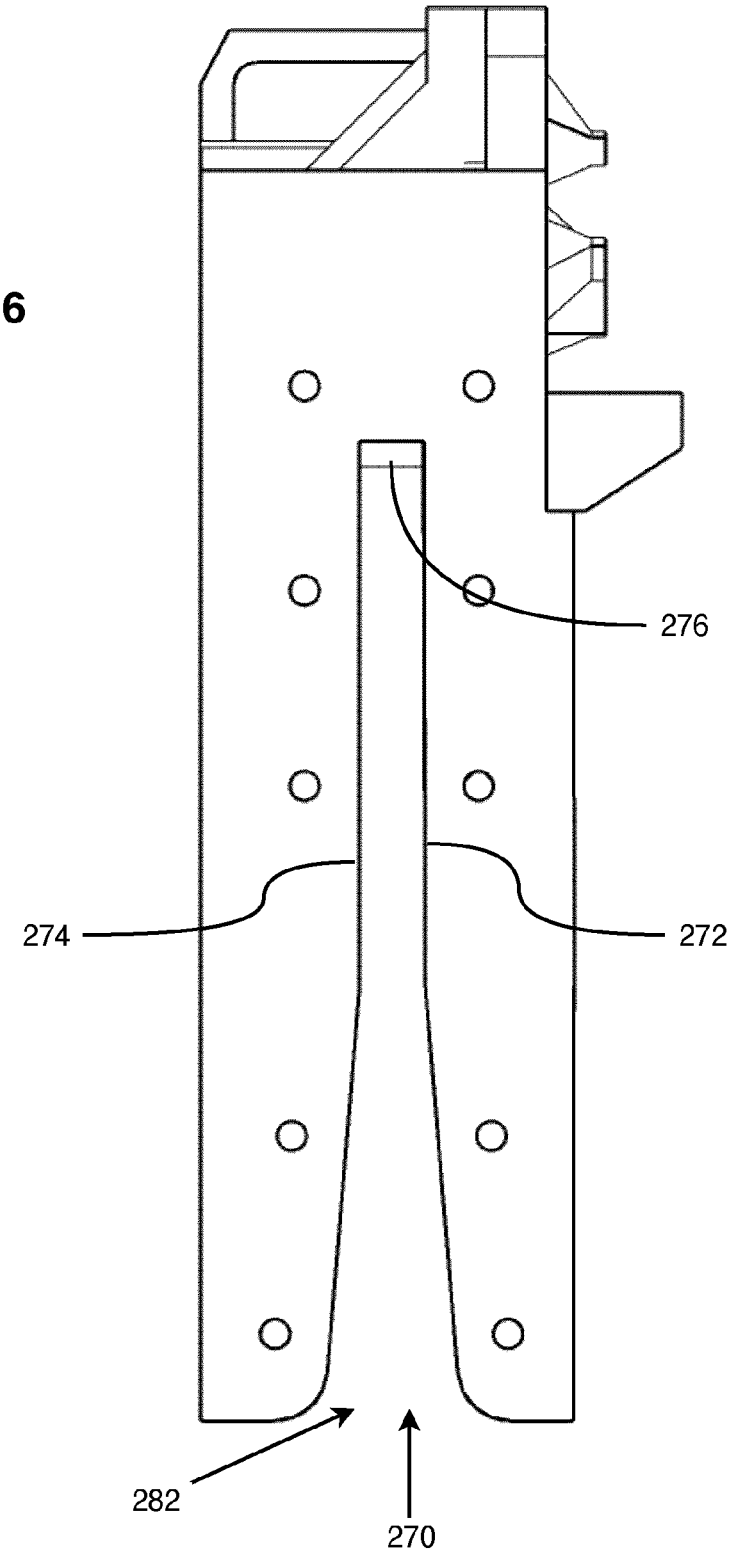
Figure 17:
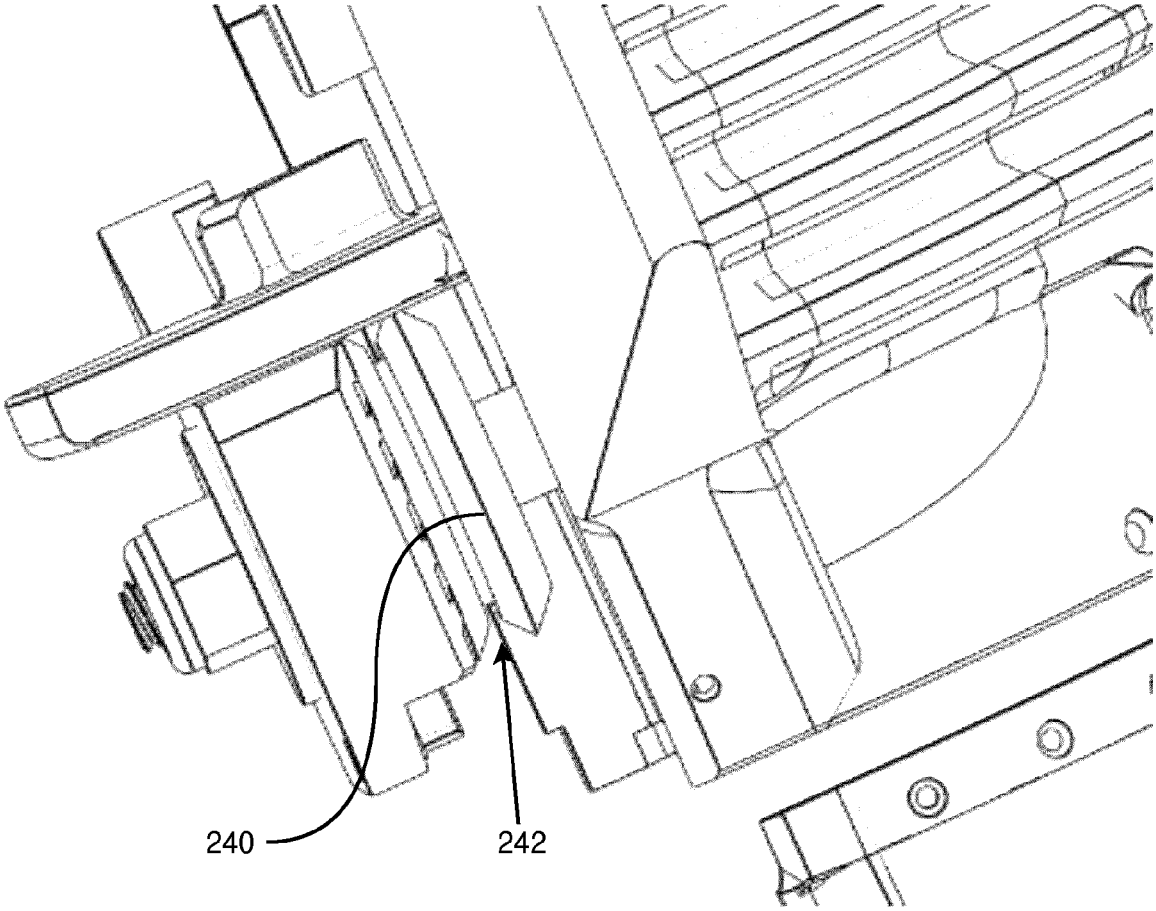
FIG. 17 is a top view of the sheave in the channel.
Figure 18:
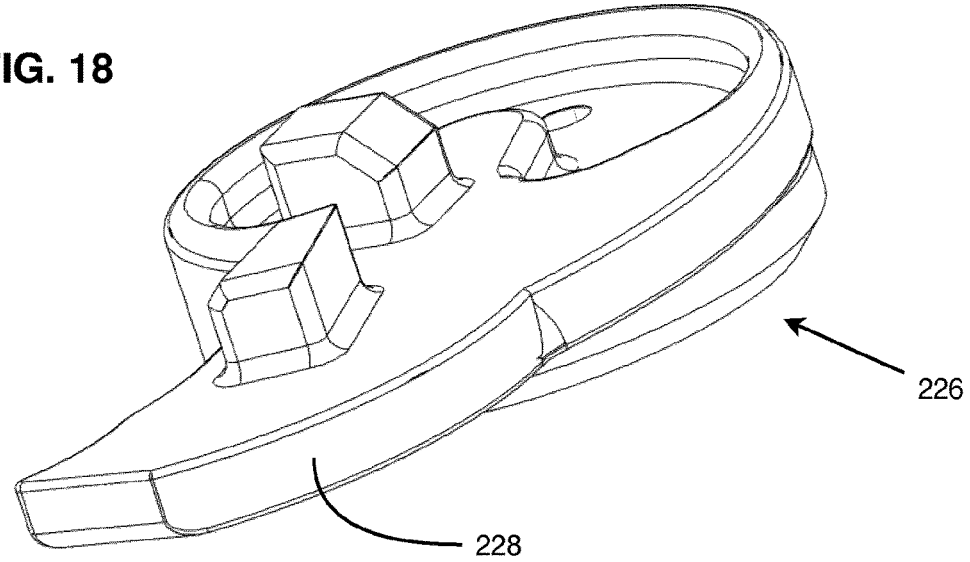
FIGS. 18 to 20 are a respectively a top perspective view, a bottom perspective view and a top view of the push member.
Figure 19:
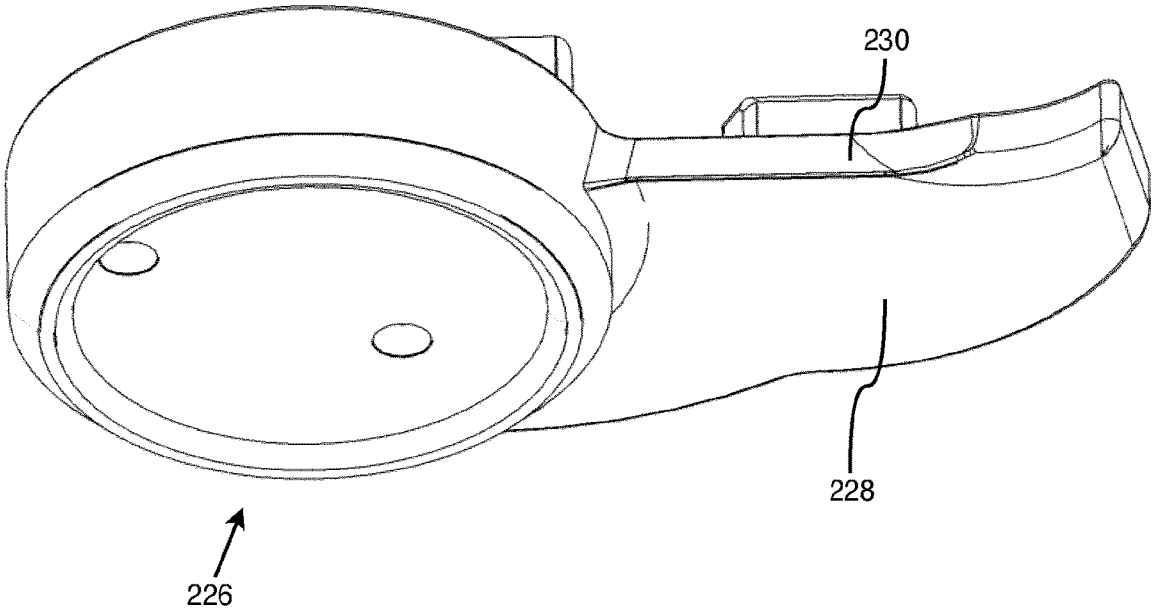
Figure 20:
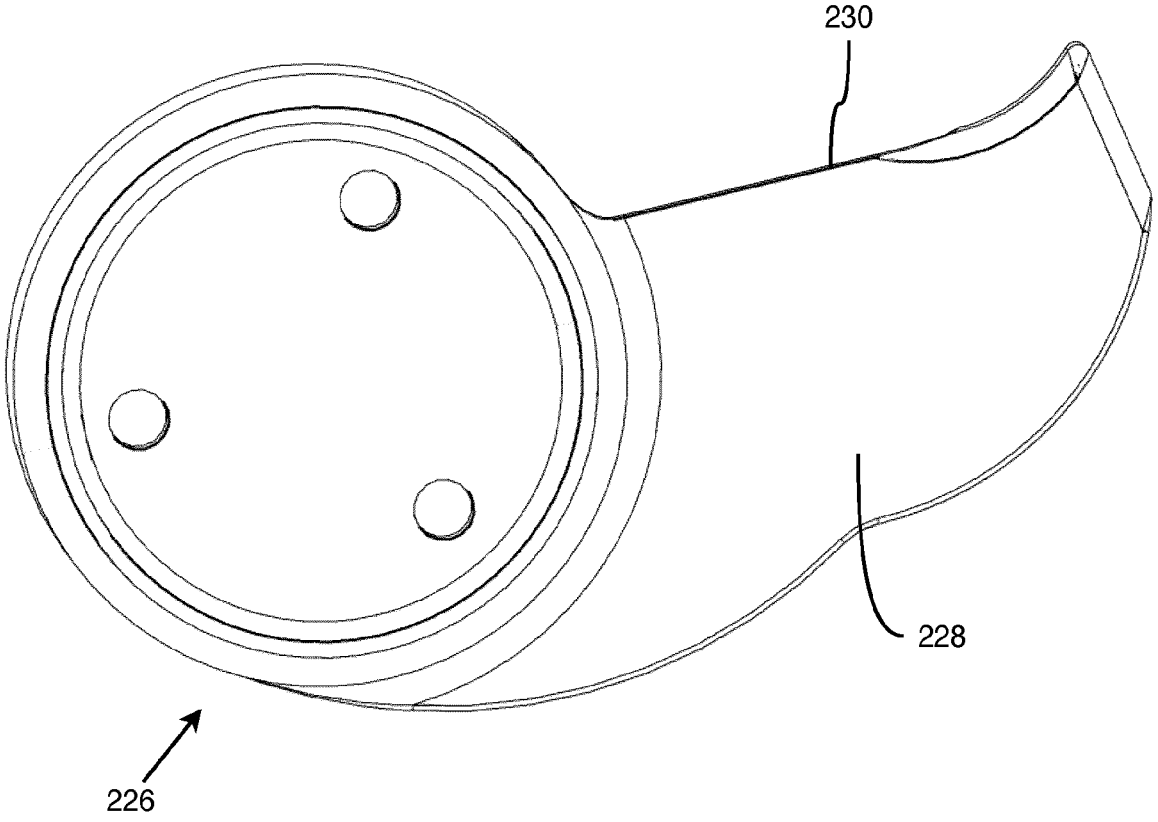

Referring now to FIGS. 5 and 6, another embodiment of a bending device 200 comprises a pole 214, a main handle 254 and a head module 220. The main handle is located about the bottom of the pole 214, being adapted for the operator of the bending device 200 to grip the bending device 200 therefrom, and the head module 220 is located at the top extremity of the pole 214 for bending hanger wires 90 hanging from the ceiling without the operator having to climb up on aids (e.g. stilts, scaffolders) to reach the hanger wires 90.

According to a realization (not depicted), a secondary handle comprises a horizontal grip while the main handle 254 provides an angled grip, with the combination of an angled grip and of a horizontal grip maximizing control of the bending device 200 while minimizing fatigue that may result from long manipulation of the bending device 200.

The main handle 254 combines also a trigger function. Accordingly, the main handle 254 and the head module 220 are electrically connected through electric wires travelling within the pole 214.

Figure 21:
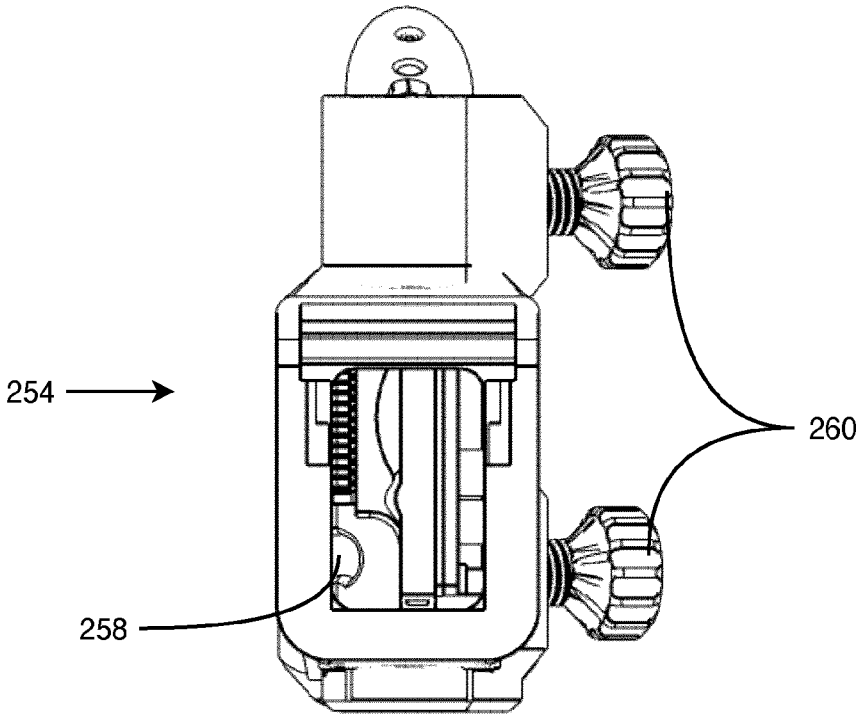
FIGS. 21 and 22 are respectively a front view and a side view of the control module of the bending device of FIGS. 5 and 6.
Figure 22:
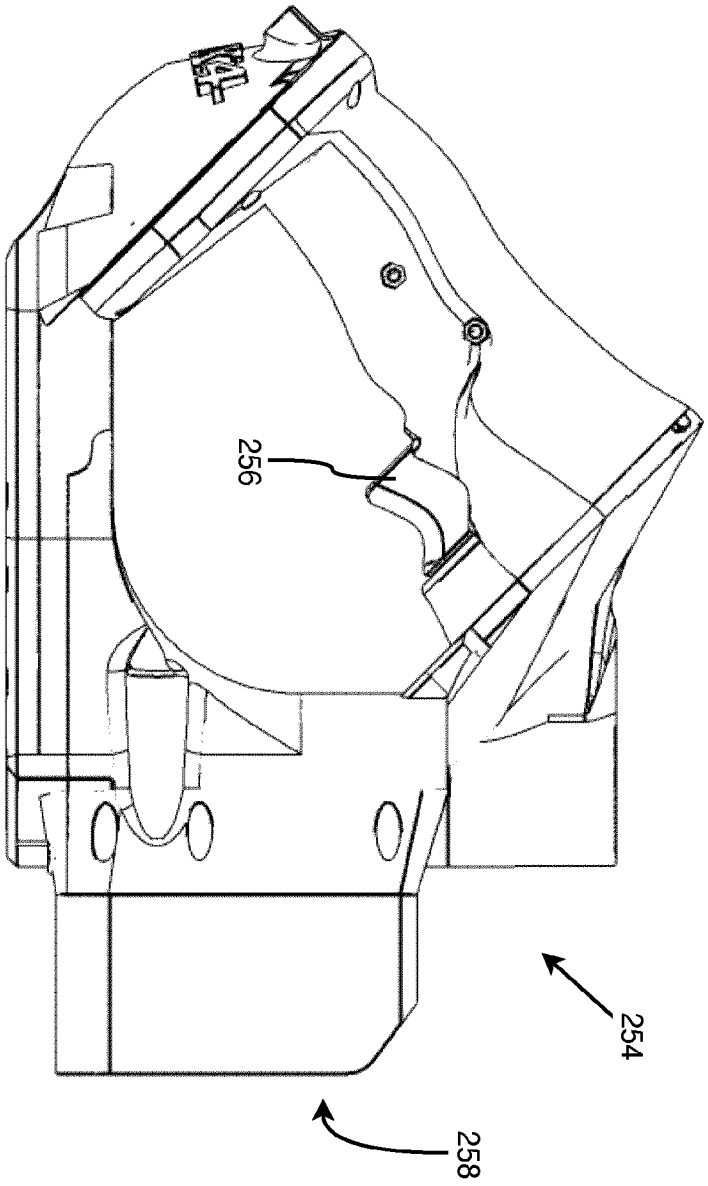

Referring additionally to FIGS. 21 and 22, the main handle 254 comprises a trigger 256, aka an activation means, and a battery-receiving interface 258. Therefore, upon pressing the trigger 256, the head module 220 is powered by the battery (not shown) mounted to the battery-receiving interface 258.

According to a realization (not shown), the trigger 256 activates a wireless connection with the head module 220 to control the motor g, e.g., operating as a radio frequency (RF) remote control. This specific realization avoids the need for wires in the pole 214 to connect to the head module 220. This solution further provides more freedom on the adjustment of the distance between the head module 220 and the trigger-featuring main handle 254.

According to a realization (not shown), the head module 220 comprises a register/memory keeping a tally of the number of bending operations performed by the bending device 200 for example for maintenance purposes. According to realizations, the register tallies electronically or mechanically the number of operations of the bending device 200.

Referring particularly to FIGS. 5 and 6, the pole 214 comprises ruler-type markings 262. The main handle 254 comprises a securing screw 260 allowing to secure or loosen the grip of the main handle 254 around the pole 214. Once the grip from the screw is loosened, the operator may slide the main handle 254 up and down the pole 214 to adjust the distance between the main handle 254 and the head module 220 with the help of the ruler-type markings 262 so that the user can adapt the bending device 200 to be used comfortably according to variable heights of ceilings.

The bending device 200 further comprises a light reflector 246 (similar to the laser light reflecting plate 146) adapted to visually shows when a laser lights the light reflector 246. By having a laser (not shown) providing a horizontal light beam operation in the workplace, the operator is able to place the bending device 200 at constant height. The operator adjusts the height of the bending device 200 for the light beam to light up the light reflector 246 with every hanger wire to be bent. Thereby the bending device 200 is always used at about the same height as the bending of the hanger wires 90.

According to realizations, the light reflector 246 may be placed at different locations of the bending device 200, for instance on the main handle 254, mounted on the pole 214 or even as a (colored) coating covering a portion of the pole. Thus, any location fulfilling the function of the light reflector 246 of facilitating the operation of the bending device 200 always at the same height, thus having hanger wires 90 bent at the same height relative to the ground, is contemplated through the present document.

According to realizations (not shown), the bending device 200 comprises an aid to help in determining if the bending device 200 vertical and thereby to help the user in maintaining it vertical. According to realizations, the aid comprises a level or a free hanging laser hanging from the head module 220, with the operator aligning the light beam from the free hanging laser with a mark (or marks) on the handle 254. Preferably, there are two levels/lasers which are in two vertical planes which are 90 degrees apart thereby ensuring better verticality with respect to the horizontal plane.

It is worth noting that the length of the pole 214 may vary from one embodiment to another. The present bending device 200 may further operate according to a plurality of poles 214 of different lengths, with the operator selecting the pole 214 based on the height of the ceiling of the workplace.

Now referring back to FIGS. 4A-4B and 5 and additionally to FIGS. 7 to 13, the bending device 200 comprises a head module 220, controlled by the trigger 256, that is adapted to bend a hanger wire 90 temporarily inserted into a funnel-shape channel 270.

The head module 220 comprises a casing 234 comprising a conduit 236 adapted for the head module 220 to be mounted to the top extremity of the pole 214.

Referring additionally to FIGS. 14 to 20, the casing 234 houses two side walls 272, 274 and a rear wall 276 defining together a channel 270 that is funnel-shaped along a portion thereof. More precisely, the channel 270 has an open top 268 and a funnel shape along a horizontal plane when the pole 214 is vertical. The channel 270 has a mouth 282 at the periphery of the casing 234. In this vertical position of the channel 270, the side walls 272, 274 are vertically parallel to each other while horizontally at an acute angle, i.e., varying between zero (0) degrees close to the rear wall 276 and about forty (40) degrees about the mouth 282 of the channel 270. The funnel shape of the channel 270 defined in-between the side walls 272, 274 helps in guiding the mouth 282 of the channel 270 with a horizontal movement toward the hanger wire 90 until the hanger wire 90 is well inserted in the channel 270.

The head module 220 further comprises a series of magnets 278, e.g., four (4) magnets 278, mounted as a vertical array to the side wall 272 about the rear wall 276. The magnets 278, once the hanger wire 90 inserted into the channel 270, help keep the hanger wire 90 in place before and during its bending. Afterwards, because the hanger wire 90 is attached to the ceiling, it is easy for the operator of the bending device 200 to move the head module 220 away from the bent hanger wire 90 and thus break contact between the hanger wire 90 and the magnets 278.

The head module 220 further comprises a sheave 240 mounted to the side wall 274. The sheave 240 features a groove 242 where the hanger wire 90 sits when contacting the magnets 278 in the channel 270. The sheave 240 provides a low-friction environment for the hanger wire 90 when forcibly bent while the groove 242 keeping the alignment of the hanger wire 90 during the bending. According to an embodiment, the sheave 240 freely rotates thereby further reducing the friction on the hanger wire 90 while it is being bent.

The side walls 272, 274 of the head module 220 feature a side conduit 284 passing therethrough. The side conduit 284 has a rectangular shape that is at an upward angle relative to and away from the rear wall 276 when the rear wall 276 is vertical. The side conduit 284 provides a passage for the tooth 228 of the push member 226 to travel in when the push member 226 rotates.

The head module 220 further comprises the push member 226 mounted to and driven by a reciprocating or bi-directional rotative motor 280. The motor 280 drives the push member 226 between an insert position, wherein the channel 270 between the side walls 272, 274 is free and the hanger wire 90 can be inserted in the channel 270, and a bend position, wherein the tooth 228 is rotated rearwardly toward the rear wall 276. During the travel of the tooth 228 between the insert position and the bend position, to forcibly bend by the hanger wire 90 the front 230 of the tooth 228 pushes the hanger wire 90 rearward while the sheave 240 provides a resistance frontward, thereby forcibly bending by the hanger wire 90. More precisely, under the forces provides by the tooth 228 and the sheave 240, the hanger wire 90 undergoes a deformation resulting in the hanger wire 90 being bent in an obtuse angle, e.g., above 90 degrees to about one-hundred-and-five (105) degrees, when compared to its zero (0) degree unbent original configuration.

Limit switches (not shown) are located at the ends of the course of the push member 226. The limit switches are in communication with a controller (not identified) located in the handle 254, itself providing signals to the motor 280 to determine the operations of the motor 280, including when to start the motor 280, in which direction the motor 280 has to operate, when to end the motor 280 since the course of the push member 226 has reached its apex or its rest position, and when to stop according to a full cycle of operation.

The motor 280, and thus the push member 226, have a rotation axis 285 that is nonparallel to a substantially vertical axis (i.e., the direction of the pole 214 while in use). The angle between the rotation axis 285 and the substantially vertical axis are oblique to each other. Such a configuration allows the hanger wire 90 to be bend over ninety (90) degrees by the push member 226, and more particularly bent to the obtuse angle discussed before.

Furthermore, the configuration of head module 220 with the sheave 240 located frontward from the bend position of the front 230 of the tooth 228 forces the hanger wire 90 to move rearward as the tooth 228 travels rearward, with the portion of the hanger wire 90 that is lower that the tooth 228 sliding upward on the sheave 240 to its bent position.

Both characteristics participate in easing the bending of the hanger wire 90 to the discussed obtuse angle.

The resulting obtuse angle of the hanger wire 90 is well adapted for the installation of suspended ceiling rails; the upward portion of the hanger wire 90 helping in keeping the rails mounted to the hanger wire 90 while the constant height of the bending of the hanger wire 90 resulting in the rails being horizontally mounted to the set of hanger wires 90 hanging from the ceiling.

According to a realization (not depicted), the bending device 200 comprises a security module connected to the control of the bending device 200. The security module comprises a sensor for detecting, using Near-Field Communication (NFC), presence of signals from an authorized operator's device close to the bending device 200. The security module is adapted to prevent the bending device 200 from being powered when no authorized operator device is detected.

According to a realization, the bending device 200 comprises a micro-controller in communication with the motor 280 (providing motor information such as rotation direction, course length, etc.) and various sensors (e.g., limit switches) to monitor the operation of the bending device 200. Furthermore, the micro-controller will store, in a memory (not shown), information on the operation of the bending device 200 and will update the stored information as additional operations of the bending device 200 occur.

It must be noted that the present document further contemplates realizations of the head module 220 as an independent tool or as a mountable tool that may be operated in cooperation with a variety of poles to mount the head module 220 thereto, with the head module 220 being, for example, electrically connected to a triggering means, or comprising a trigger to electrically power the head module 220.

Normal steps for the installation of a suspended ceiling with the bending device 100/200 comprises preparation steps, hanger wire installation steps and installation steps.

The preparation steps are steps performed for preparation of the workplace in order to perform the steps hanger wire installation steps. The preparation steps comprise having the tools and material necessary for the installation of the suspended ceiling, to sketch the configuration of the suspended ceiling, with corresponding marks marked or placed on the ground for reference. The marks are used as explained before as guides to install the hanger wires 90. The preparation steps further comprise adjusting the length of the bending device 100/200 and to install a horizontal laser to operate at the same height with all of the hanger wires 90.

The hanger wire installation steps comprise first the installation of the hanger wire according to the marks using for instance an extendible tool holder object of another application from the same applicant. The installation of a wire hanger comprises drilling a hole in the ceiling, to set an anchor in the hole, and to attach the hanger wire 90 to the anchor with the hanger wire 90 hanging therefrom.

The hanger wire installation steps further comprise to use the bending device 100/200 by inserting the hanger wire 90 in the channel 120/220 while respecting the desired height by looking at height of the laser beam on the laser light catching plate 146/246 and while holding the bending device 100/200 vertical. It is thus easy to move the bending device 100/200 up and down to adjust the height relative to the hanger wire 90. The hanger wire 90 will remain in the channel 100/200 under the force of the magnets 278.

Once the hanger wire 90 is set in place in the channel 100/200, the following step is to trigger the bending device 100/200 resulting in the hanger wire 90 being bent. In the case of the bending device 200, the trigger 256 electrically powers the motor 280, resulting in the push member 226 moving from the insert position to the bend position, and returning after having completed its course to the insert position.

Once the hanger wire 90 is bent, the operator pulls down the bending device 100/200, with the contact between the magnets 278 and the hanger wire 90 being broken at that time. The hanger wire 90 therefore remains hanging freely from the ceiling bent at the desired height and the desired bend angle and the operator is free to move to the next hanger wire 90.

The hanger wire installation steps are repeated for each hanger wire 90 until all the hanger wires 90 are installed and bent.

Finally, the installation steps comprise installing rails to the hanger wires 90 and to mount suspended ceiling tiles to the hanging rails. The installation steps comprise to adapt the tiles to lighting requirements, air ducts, electric devices and other requirements.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A bending device for bending a hanger wire hanging vertically from a ceiling, the bending device comprising:

a pole having a top extremity; and a head module mounted to the top extremity of the pole, comprising:

a casing having an interior;

a channel housed in the interior of the casing, the channel extending vertically for receiving the hanger wire and comprising a first wall, wherein the channel is configured such that when the hanger wire, is inserted in the channel the hanger wire butts up against the first wall of the channel inside the casing; and a push member rotatably mounted in the interior of the casing, the push member comprising a tooth, the push member rotatable between a) an insert position, wherein the push member does not cross the channel whereby the channel is free to receive the hanger wire, and b) a bend position, wherein, between the insert position and the bend position, the push member is adapted to rotate such that the tooth travels in the interior of the casing, crosses the channel and pushes against the hanger wire within the channel while the hanger wire butting up against the first wall thereby bending the hanger wire.

2. The bending device of claim 1, wherein the casing comprises a sheave housed in the channel below the push member, and wherein the sheave is adapted for the hanger wire to abut thereagainst, thereby having the sheave forcing the hanger wire in a direction which is opposite to displacement of the tooth when the tooth pushes against the hanger wire.

3. The bending device of claim 1, wherein the head module further comprises a second wall delimiting the channel having an open top, wherein the first wall and the second wall extend in respective vertical planes which are parallel to each other.

4. The bending device of claim 3, wherein the first wall and second wall define a funnel shape along a horizontal plane.

5. The bending device of claim 3, wherein the first wall and the second wall define a conduit providing passage to the push member while rotating from the insert position to the bend position.

6. The bending device of claim 1, wherein the head module comprises a magnet mounted in the channel for holding the hanger wire in place horizontally.

7. The bending device of claim 1, further comprising a motor housing in the casing, wherein the motor drives the push member.

8. The bending device of claim 7, further comprising a main handle mounted on the pole distant from the head module, the main handle comprises a trigger for activating the motor and thereby driving the push member.

9. The bending device of claim 8, wherein the main handle comprises a battery-receiving interface.

10. The bending device of claim 8, further comprising a secondary handle distant from the head module.

11. The bending device of claim 1, wherein the pole further comprises a fixed handgrip and a rotatable handgrip rotatable relative to the fixed handgrip, wherein both the fixed handgrip and the rotatable handgrip are distant from the top extremity of the pole, and wherein the rotatable handgrip is mechanically connected to the push member such that rotation of the rotatable handgrip relative to the fixed handgrip drives the push member.

12. The bending device of claim 1, further comprising a level to measure a verticality of the pole with respect to a horizontal plane.

13. The bending device of claim 1, further comprising a light reflector mounted to the pole and comprising a light reflecting material, wherein the light reflector is adapted to reflect light from a laser leveling device.

14. The bending device of claim 1, wherein the push member is configured to rotate around an axis oblique to the channel.

15. A bending device to be mounted to a pole as a head module adapted for bending a hanger wire hanging vertically from a ceiling, the bending device comprising:

a casing having an interior;

a motor housed in the casing;

a channel in the interior of the casing, the channel extending vertically for receiving the hanger wire and comprising a first wall, wherein the channel is configured such that when the hanger wire is inserted in the channel the hanger wire butts up against the first wall of the channel inside the casing;

a push member, rotatably driven by the motor, that is configured to be rotated in the interior of the casing, the push member comprising a tooth, the push member being configured for rotating between a) an insert position, wherein the push member does not cross the channel whereby the channel is free to receive the hanger wire, and b) a bend position, wherein, between the insert position and the bend position, the push member is configured to rotate such that the tooth travels in the interior of the casing, crosses the channel and pushes against the hanger wire within the channel while the hanger wire butts up against the first wall thereby bending the hanger wire; and a means for activating the motor and thereby driving the push member.

16. The bending device of claim 15, further comprising a sheave housed in the channel below the push member, and wherein the sheave wire is adapted for abutting against the hanger wire therefore having the sheave forcing the hanger wire in a direction which is opposite a direction in which the tooth of the push member travels to bend the hanger wire.

17. The bending device of claim 15, further comprises a first wall and a second wall delimiting the channel having an open top, wherein the first wall and the second wall extend in respective vertical planes which are parallel to each other.

18. The bending device of claim 17, wherein the first wall and second wall define a funnel shape along a horizontal plane.

19. The bending device of claim 17, wherein the first wall and the second wall define a conduit providing passage to the push member while rotating from the insert position to the bend position.

20. The bending device of claim 15, wherein the push member is configured to rotate around an axis oblique to the channel.

* * * * *